United States Patent [19]

Graham

[11] Patent Number: 4,569,448

[45] Date of Patent: Feb. 11, 1986

[54] EXPANDABLE STORAGE SYSTEM

[75] Inventor: Charles H. Graham, Salt Lake City, Utah

[73] Assignee: C/H Research Associates, Salt Lake City, Utah

[21] Appl. No.: 498,851

[22] Filed: May 27, 1983

[51] Int. Cl.[4] ..... A47B 73/00

[52] U.S. Cl. ..... 211/74; 211/81; 211/89; 211/169; 16/383; 24/662; 40/530; 160/231 R; 248/312.1; 248/313; 403/71

[58] Field of Search ..... 211/74, 75, 169, 89, 211/76, 81, 79, 80, 103; 160/132, 231 R, 231 A, 196, 196 D; 403/71; 16/382, 383, 311, 312, 309; 24/625, 662, 664, 681, 618, 619; 40/530, 535, 533, 534, 537; 248/312.1, 311.2, 313, 221.1, 220.3

[56] References Cited

U.S. PATENT DOCUMENTS

| | | | |
|---|---|---|---|
| 506,893 | 10/1893 | Wood | 40/537 |
| 712,724 | 11/1902 | Ross | 248/220.3 X |
| 835,615 | 11/1906 | Henricks | 40/537 X |
| 1,010,949 | 12/1911 | Polverino | 40/530 X |
| 1,026,561 | 5/1912 | Charlet | 40/535 X |
| 1,254,036 | 1/1918 | Grant | 211/169 X |
| 1,571,000 | 1/1926 | Eustis | 211/89 X |
| 2,239,798 | 4/1941 | Tinnerman | 24/662 X |
| 2,616,142 | 11/1952 | Tinnerman | 24/662 |
| 3,154,281 | 10/1964 | Frank | 248/220.3 X |
| 3,179,969 | 4/1965 | Glynn | 24/625 X |
| 3,326,268 | 6/1967 | Dixon | 160/231 A |
| 3,733,650 | 5/1973 | Douglas | 16/312 |
| 3,921,948 | 11/1975 | Long | 248/313 X |
| 4,126,173 | 11/1978 | Theuerkauff | 160/231 R X |
| 4,270,290 | 6/1981 | Eckert | 40/537 X |
| 4,285,556 | 8/1981 | Loeffel | 211/169 X |
| 4,304,382 | 12/1981 | Jelen | 248/221.1 |

FOREIGN PATENT DOCUMENTS

| | | | |
|---|---|---|---|
| 1190491 | 10/1959 | France | 16/382 |

*Primary Examiner*—Robert W. Gibson, Jr.
*Assistant Examiner*—Blair M. Johnson
*Attorney, Agent, or Firm*—Workman, Nydegger & Jensen

[57] ABSTRACT

An expandable storage system for securely storing materials of various shapes and sizes in an organized, easily identifiable and accessible manner. One or more rows of support members are removeably secured upon a panel so that their positions on the panel may be easily changed in order to secure materials of varying sizes and shapes. A resilient upper support member applies downward pressure on stored materials so that they are held securely against the other support members in order to minimize movement. Additional panels may be quickly added to the system by snapping hinge members to the panel edge and connecting those hinge members, by gravity support, to hinge members on an adjacent panel. Locations are provided for labels and other information relating to stored materials, with no separate space required for the label location. The storage system may be removeably mounted on a structural surface during use and may be secured in a closed configuration similar to a suitcase for transporting.

29 Claims, 11 Drawing Figures

EXPANDABLE STORAGE SYSTEM

BACKGROUND

1. The Field of the Invention

The present invention relates to storage and organizing systems and, in particular, to a wall mountable system for securely retaining and providing ready identification and access to stored materials.

2. The Prior Art

Systems, devices, and methods for storing and organizing articles are well-known and available in many different embodiments for many applications. Generally, the goal of such organizers and storage systems is to provide reasonable access to the stored items, while securely maintaining them in a minimal amount of space.

Storage systems and devices for storing smaller articles such as hand tools and parts are often used in shops, work areas, homes and the like. These systems and devices may include such things as conventional shelves; individual containers, boxes, jars and the like; storage chests and cabinets containing various sizes and types of drawers; and rotatable carousel systems which may utilize some of the embodiments described above. Unfortunately, none of the systems utilized for storing smaller articles appear to have been able to accomplish simultaneously all of these goals.

For example, shelf systems may provide easy access to stored items, but generally do not easily lend themselves to maintaining any type of article organization. Individual containers provide a means for separating groups or types of articles, but the containers themselves must, somehow, be secured in an organized fashion to provide accessibility and ease of identification of the stored materials.

Chests and cabinets containing drawers provide a means for segregating items, but even these devices are limited in organizing ability. For example, the drawers should be removable so that the user can carry the items he needs to his work space without moving the entire cabinet or chest. With several drawers removed, it is often difficult to determine which drawer belongs in which storage location of the cabinet or chest. Thus, a labeling system is necessary so the user can easily determine where to reinsert the drawer. Such a labeling system typically requires placement of information on surfaces adjacent the drawer location, and these adjacent surfaces are provided by increasing the spacing between the drawers.

Even if the drawers are not removeable, the forward end of the drawer is often transparent so that the drawer contents can be viewed to determine such things as quantity size, and type. In many cases, if labels were applied directly to the face of the forward end of the drawer, it would not be possible to view the contents. As a result, the systems also typically provided surfaces adjacent the drawer location for affixing labels and information. Thus, total storage area is increased in each of those drawer systems just so that surfaces can be provided for labeling purposes.

Each of the above-described prior art systems also experiences problems either with transportability, versatility, or both. For example, shelving is quite versatile in its ability to support many different types and sizes of items; however, it is almost impossible to transport the shelving without removing the materials positioned thereon. Individual containers are less versatile than shelves because of their fixed dimensions. The containers are also difficult to organize and transport in groups without providing some other type of support or storage system to retain the containers. Some chests and cabinets containing drawers are designed to be transportable, but the fixed dimensions of their drawers and storage areas severely limit their versatility with respect to the storage of materials of varying types and sizes. Once designed and built, cabinets and chests do not provide the capability of removing a given drawer or storage area and replacing it with another of a different size which is designed to accommodate different materials.

An additional problem relating to the transportability of each of these types of storage devices is that jostling or tilting of the device during handling or transport may result in spilling or mixing of the containers or, in the case of chests and cabinets, of the materials stored in the drawers.

Still another problem with prior art systems for storage and organization is their inflexibility with respect to expansion of storage capacity as the users' needs increase. It is often the case that a user has initially purchased or built systems for organizing and storing his materials based on his present needs or his short term expectations. However, as time passes many users "outgrow" those initial systems and there arises a need to expand. Because of the expense and inconvenience involved in acquiring additional work space, it is usually most desirable to minimize the space required for expansion of the organizing and storage systems. Typically, expansion of prior art storage systems requires building additional shelves, buying more containers, or purchasing additional chests or cabinets. Hence, a significant increase in storage area is often required in order to accomplish expansion.

In view of the foregoing, it will be appreciated that what is needed in the art is an organized storage system for securely retaining items of various sizes in a minimum amount of space, while providing for ready and easy identification of, and access to, stored materials. The system should additionally provide a means for quickly expanding the storage capacity without significantly increasing the area occupied by the storage system. It would be a still further improvement in the art to have such a system which could be easily transported by hand and which, while being transported, would protect the stored contents from spilling or other damage, even when the system is positioned in unusual attitudes.

BRIEF SUMMARY AND OBJECTS OF THE INVENTION

The present invention comprises an expandable storage system for securely retaining and storing materials of various shapes and sizes in an easily identifiable and accessible manner. The system includes at least one panel which may be affixed to a structural surface such as a wall; positioned upon the panel are one or more rows of support members which may be constructed as strips. The strips are adjustable in their position on the panel, so as to permit versatility in the size of the materials which are to be secured by the support members.

The support members are configurated so that the stored materials may be directly loaded and unloaded therefrom, with the minimum necessary space separating the materials when in the stored position. Additional panels may be added to the system as needed by securing the panels in parallel, adjacent position and affixing one of the common, adjacent ends to hinge members. The hinge members may be easily secured to the periphery of the panel edge by snapping them in place, and the hinges on adjacent panels are connected to each other by means of gravity support. Thus, hinges may be added to panels and then connected to the hinges on other panel members so that the system may be rapidly expanded as needed, with the connected panels positioned in rotatable configuration adjacent each other.

Labeling capability is provided such that, when the system is in the closed position, individual panels may be identified by information positioned upon their edges. Materials stored upon a particular panel may be identified by placing a label on the materials or on the container in which they are stored. Corresponding labels may be positioned on any of several available locations on the panel or support member in order to identify the storage location of the materials. Other information (e.g., part numbers, quantity to be ordered, and price) may also be positioned upon the adjacent panel without requiring any extra space. The system thus provides for the rapid identification of particular stored materials and their associated storage locations, without increasing the required storage space.

It is, therefore, a primary object of the present invention to provide an improved system and method for organizing and storing numerous types and configurations of materials in a small area.

Another important object of the present invention is to provide a storage system and method of organizing materials which provides for quick identification and ready accessibility of any of the stored materials, while securely retaining the stored materials in order to prevent spillage or other damage during storage and transportation.

Yet another significant object of the present invention is to provide a modular storage system which may be rapidly and easily expanded to increase storage capability with a minimum increase in overall storage system size.

A further object of the present invention is to provide a materials storage system which may be affixed to a structural surface during use, and which is additionally easily transportable by hand.

Still a further object of the present invention is to provide a materials storage system which includes adjustable retaining devices so that any selected portion of the system may be modified to receive and store any one of numerous different sizes and configurations of materials.

These and other objects and features of the present invention will become more fully apparent from the following description and appended claims taken in conjunction with the accompanying drawings.

DETAILED DESCRIPTION OF THE PREFERRED EMBODIMENTS

Figure 1:
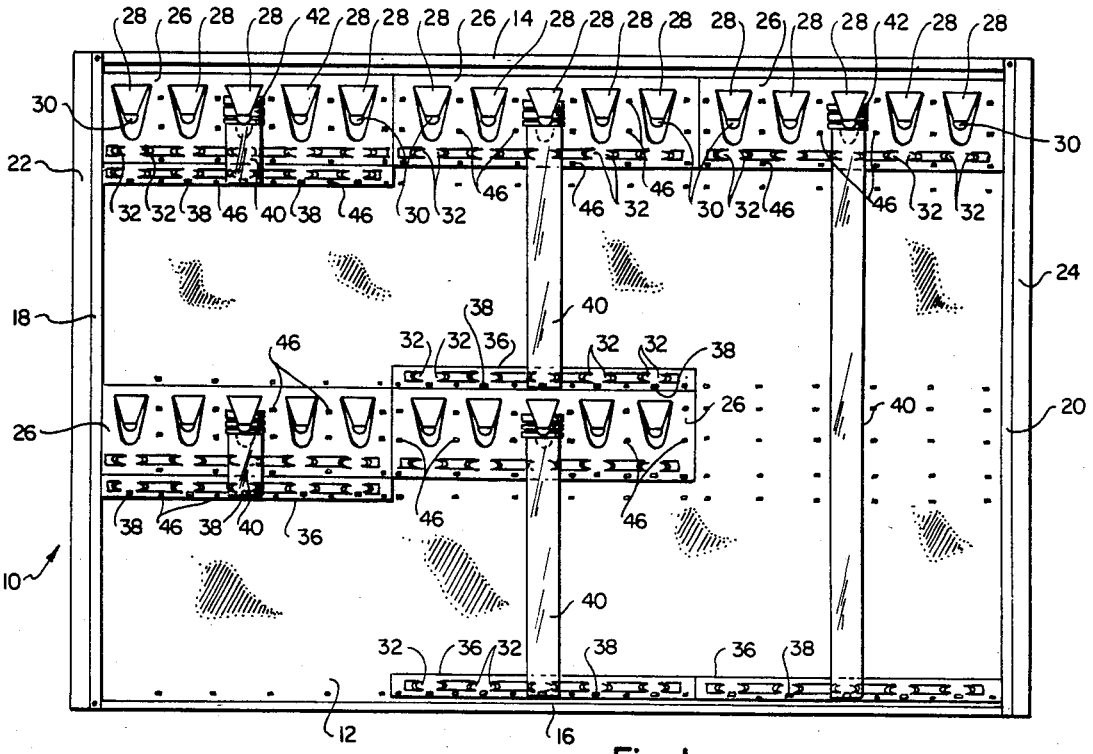
FIG. 1 is a front elevational view of one presently preferred embodiment of a storage panel within the scope of the present invention.

Reference is now made to the drawings wherein like parts are designated by like numerals throughout. Referring initially to FIG. 1, one preferred embodiment of the storage system of the present invention is generally designated at 10. The storage system 10 comprises a support member or back panel 12 which is typically constructed from a metallic sheet of material such as aluminum. Back panel 12 is of unitary construction with its upper, lower, and side portions bent forward to form, respectively, top edge 14, bottom edge 16, and side edges 18 and 20. The outer portion of side edges 18 and 20 extends forward from the face of the back panel 12 beyond the other edges so as to form spacers 22 and 24, respectively. As will be explained more fully hereafter, when multiple back panels are positioned adjacent one another, the forward ends of spacers 22 and 24 contact adjacent panels and thereby prevent contact between the adjacent panels and the materials stored on the back panel 12.

Positioned upon the face of back panel 12 are a plurality of strips, many of which are configured to form upper retainer shelves 26. Each upper retainer shelf 26 comprises a metallic sheet having portions which are cut and bent outwardly to form retaining members. Retaining shelves 26 may comprise a continuous strip extending across the length of back panel 12, or they may comprise shorter strips positioned upon the back panel so as to permit multiple strips to be positioned across the back panel in order to retain articles of various sizes and lengths.

Extending generally outwardly from upper retainer shelves 26 are one or more resilient finger springs 28 which are biased downwardly so as to receive and secure the upper portion of items to be stored. The forward end of each finger spring 28 is bent generally downwardly to form a retaining lip 30. Lip 30 acts to prevent the forward motion of articles which are stored in the storage system, and which are in contact with downwardly biased finger springs 28.

Symmetrically positioned below and on either side of the center line which extends downwardly from the fingersprings are cradle tabs 32. Specifically, cradle tabs 32 each comprise a metallic tab which extends outwardly toward the side edges of the back panel. Cradle tabs 32 cooperate with one another to form a cradle arrangement for receiving the body portion of an article stored in the storage system, thereby minimizing the lateral movement of the stored item with respect to the face of back panel 12. Also oriented on upper retainer shelves 26, as explained more fully hereafter, are a plurality of securing apertures 46 which are utilized in conjunction with tabs positioned on the face of back panel 12, for removably securing retainer shelves 26 adjacent the face of back panel 12.

The remaining metallic strips positioned upon the face of back panel 12 define lower retainer shelves 36. The lower retainer shelves 36 provide a means for securing the lower portion of an article adjacent the face of back panel 12. As with the upper retainer shelves 26, lower retainer shelves 36 include a plurality of cradle tabs 32 which are constructed in a manner identical to the cradle tabs 32 of the upper retainer shelves.

Lower retainer shelves 36 include an upwardly extending member comprising a lower detent 38 which defines a receiving slot between its inner surface and the face of the lower retaining shelf. Lower detent 38 thus serves to receive a lower edge of an article to be secured, and to retain that lower so that the lower portion of the article is retained adjacent to the face of back panel 12.

In use, lower retainer shelves 36 are positioned in vertical alignment with upper retainer shelves 26, and are spaced from shelves **26*a*** a distance necessary to receive and secure a selected article to be secured.

One preferred article for use in securing small, fragile, or unusually shaped materials within storage system 10 comprises a tubular container 40. Container 40 typically includes a hollow interior for retainer materials to be stored, with a closed bottom and a removable top comprising a cap 42. After securing materials within the open container 40, cap 42 is secured to the container, which is then positioned adjacent the face of back panel 12 so as to be secured in the manner illustrated in FIG. 1. The means by which container 40 is placed in stored position described more fully hereafter with respect to FIG. 2.

It will be readily appreciated that the length of container 40 is dependent upon the types of materials to be stored therein. Thus, containers of several different lengths are illustrated in FIG. 1 for purposes of example. It can also be seen that, depending upon the length of the container 40, the upper and lower retainer shelves, 26 and 36, respectively, may be adjustably positioned upon the surface of back panel 12 so as to cooperate with and to secure the upper and lower ends of the container 40 in storage position adjacent the surface of back panel 12.

With the storage system configurated as illustrated in FIG. 1, it becomes readily apparent that identification of specific containers 40 and their assigned storage locations can be easily accomplished without utilizing any additional storage space. For example, the contents of a particular container 40 may be identified by applying a conventional label to the surface of container 40. Of course, other information could also be included on the label, such as, for example, an indication of the containers storage location in the storage system 10.

Any conventional means for identifying storage locations could be easily applied; for example, numbering each storage position from left to right and from top to bottom or, identifying each storage position in accordance with its particular location in a row and column of a system. Corresponding storage location information can also be placed on a position such as the corresponding retaining lip 30, finger spring 28, or the face of back panel 12 which lies behind the stored position of the selected container 40. By use of this method, a user may look at the label on a selected container, and then quickly identify the corresponding location on the storage system so that the container 40 can be efficiently returned to its proper storage position. One more means for accomplishing this purpose would be to color code the various containers 40 and their corresponding storage locations.

The configuration of the storage system 10 additionally lends itself to presenting other types of information without any increase in size of the storage system. For example, inventory information such as part numbers, contents, price, and ordering information can be placed on the surface of back panel 12 adjacent the storage position of a corresponding container 40. If the containers 40 are transparent, and if they contain stored materials such as small parts or fluids, it is possible to put a scale upon the face of back panel 12 directly behind the container 40, so that a user may quickly examine the level of the stored material and determine the appropriate quantity which is stored.

The system also lends itself to identification of stored materials other than containers 40. In this situation, for items having distinctive shapes such as hand tools and the like, the outline of the selected tool may be traced onto the adjacent face of back panel 12 so as to provide another means of identifying the storage location of that particular device. Alternate embodiments of retainer shelves 26 and 36, designed for storing other types of materials, are discussed in more detail hereinafter with reference to FIG. 9.

The means for mounting retainer shelves 26 and 36 to the surface of back panel 12 can best be described by reference to FIG. 2. Extending forwardly from the face of back panel 12 are a plurality of assembly tabs 44 which are preferably integral with the surface of back panel 12, and are formed by cutting and bending outwardly a portion of the surface of back panel 12. A plurality of assembly apertures 46 are positioned in the surface of both upper and lower retainer shelves 26 and 36, respectively, so as to each align with an assembly tab 44 when shelf 26 or 36 is positioned adjacent the back panel. In assembled configuration, the assembly tabs 44 extend through the aligned assembly aperture 46, and their forward ends are then bent so as to lie adjacent the face of shelf 26 or 36, thereby retaining the shelf adjacent the surface of back panel 12.

The method of inserting and removing a container 40 with respect to the storage system is also best described by reference to FIG. 2. The container 40 is secured by inserting it in an upward direction so that the top of its cap 42 contacts the downwardly biased finger spring 28 at a position rearward of the retaining lip 30. While maintaining upward pressure on the container 40, its body is moved so as to be parallel and adjacent to the outward surface of retainer shelves 26 and 36.

It is noted that one preferred embodiment of the container 40 includes a lower lip 48 which extends downwardly from a position about the periphery of the entire lower edge of container 40. With the container 40 positioned adjacent the outer surfaces of retainer shelves 26 and 36, lower lip 48 is aligned such that when the user releases his upward pressure from container 40, the downward bias of fingerspring 28 causes container 40 to move downward so that lower lip 40 is received and secured in the notch formed between lower detent 38 and the surface of lower retainer shelf 36.

With container 40 in the stored configuration, longitudinal movement thereof is minimized by the downward pressure upon cap 42 from finger springs 28. Forward movement of container 40 is also minimized by retaining lip 30, and lateral movement of the container 40 is minimized by cradle tabs 32.

Figure 3:
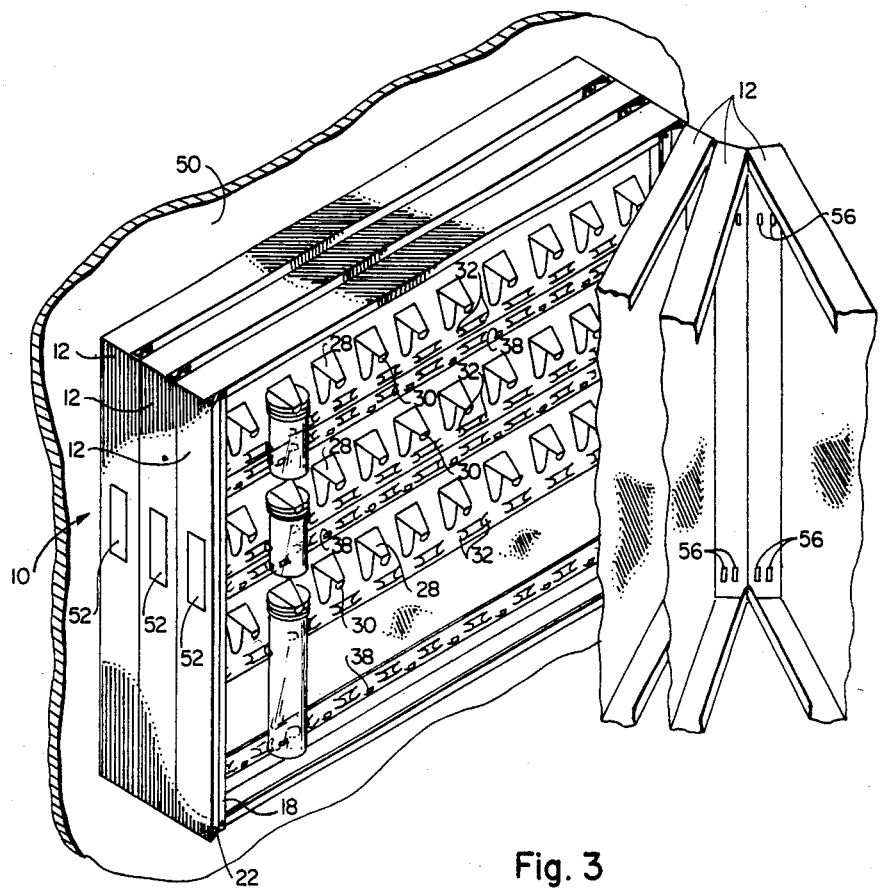
FIG. 3 is a partially cutaway, perspective illustration of the storage system of the present invention as expanded to include several storage panels.

Referring now to FIG. 3, it can be seen that the storage system 10 may be supported by affixing it to a support structure such as a wall 50. The back panel 12 is secured to the wall by conventional securing means such as screws (not shown) which are driven through back panel 12 into wall 50. Alternatively, the system may be removably mounted to the wall by use of any well-known mounting systems, such as those used for removably securing pictures to a wall.

As is described above, the storage system of the present invention is configurated so that a plurality of back panels 12 may be connected in parallel, adjacent position as illustrated in FIG. 3. The adjacent panels are secured so as to be rotatable along one side edge with respect to the other back panels 12. Specifically, the adjacent panels are secured and interconnected by hinge members 54 (see FIG. 4) which are secured to the back panel by hinge anchors extending through hinge retainer slots 56. The hinge members are connected to the adjacent back panels 12 along the edges of common ends.

Identification of individual back panels may be accomplished by securing conventional labels 52 to an exterior surface such as a top or side edges of the back panel 12. It is also noted that the individual back panels 12 may be positioned so that their contents face either forward or rearward with respect to wall 50, as may be desired by the user.

The expandable storage system 10 may be made transportable by affixing carrying handles (not shown) to the top edge of one or more of the back panels 12. In addition, when more than one back panel is included in the storage system 10, a conventional securing means (not shown) such as a latch or cord may be utilized to connect and secure the back panels 12 in the closed position. When more than one back panel is included in a portable storage system, the outer two back panels are generally configurated so that their contents face inwardly, thereby protecting the contents while in the closed position and during transport.

Figure 4:
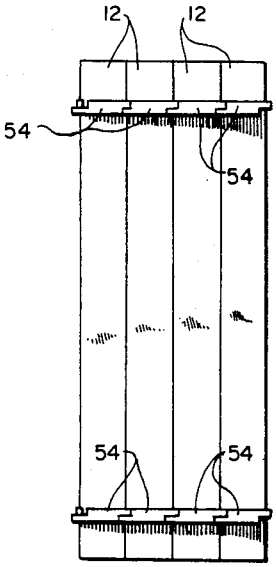
FIG. 4 is a side elevational view of the storage system of FIG. 3, illustrating the position of the support hinges in relation to the storage panels.

The hinge arrangement utilized for securing the parallel back panels 12 in adjacent position may be described by reference to FIGS. 4–7. With reference particularly to FIG. 4, it is seen that one preferred embodiment for securing and supporting end panels 12 is to position at least two hinge pieces 54 on each adjacent panel edge, each such hinge piece being positioned generally on either the top or bottom portion of the particular back panel edge.

Figure 5A:
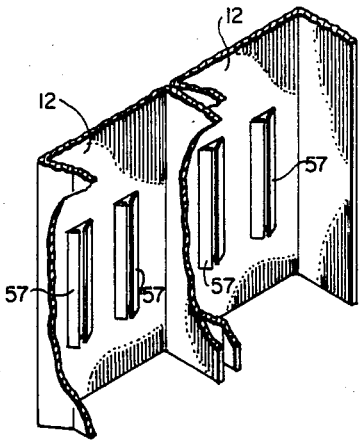
FIG. 5A is an enlarged perspective view of the interior of the hinge edge of FIG. 5, illustrating the means by which the supporting hinges are secured to the supporting panels.

Referring now to FIG. 5A it is possible to describe the means by which the hinge pieces 54 are secured to the edge of back panel 12. In particular, it will be seen that each hinge retainer slot 56 includes a pair of inwardly extending tabs 57 which are formed by bending the material comprising the central portion of the retainer slot 56 so as to angle inwardly toward the interior of back panel 12.

Figure 5:
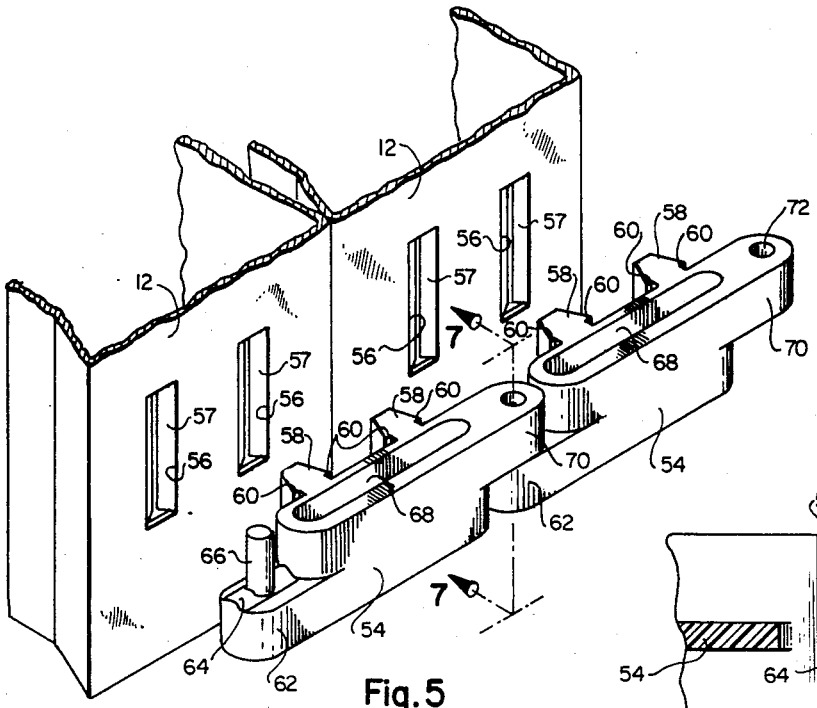
FIG. 5 is an enlarged perspective view of a portion of the hinge edge of the storage panels, and of the associated supporting hinges, particularly illustrating the means by which the supporting hinges are interconnected with each other, and connected to the supporting panels.

By reference to FIG. 5 it may be seen that each hinge piece includes a pair of hinge anchors 58 which are secured upon the body of the hinge piece so as to form a configuration which is aligned with and may be received through the retainer slots 56. The forward portion of each hinge anchor is tapered outwardly in the rearward direction from a blunt, narrow forward end so as to define an arrowhead configuration. In each side of each hinge anchor 58 and adjacent the forward face of the hinge piece 54, is a lock slot 60. As is more fully explained hereafter, the lock slots 60 function in cooperation with the tabs 57 to secure the hinge piece 54 against the side edge of the back panel 12.

Extending outwardly from one lower end portion of hinge piece 54 is lower support platform 62. A longitudinal ridge 64 is positioned upon the upper surface of the lower support platform 62 so as to extend in alignment with the longitudinal axis of hinge piece 54. Directly above the central portion of longitudinal edge 64 is a hinge pin 66 which comprises both the means for connecting adjacent hinges, and the axis of rotation of adjacent hinges. The embodiment of the hinge piece described herein includes a hinge cavity 68 comprising an aperture extending substantially through the middle portion of the hinge piece 54 so as to remove excess and unnecessary weight and material.

Extending from the other end portion of the hinge piece 64, opposite the lower support platform 62, is an upper support platform 70. Extending through the central portion of the upper support platform 70 is a pin socket 72 having a diameter which is very slightly larger than the hinge pin 66, so that hinge pin 66 may rotatably be received within socket 72. The outer ends of both the lower support platform 62 and the upper support platform 70 are rounded in configuration so that when adjacent hinges rotate about the hinge pin, there is no contact along their end edges.

In order to attach a hinge piece to the edge of a back panel 12, the hinge anchors 58 are aligned with the retainer slots 56 and the hinge piece is pressed forwardly. As the hinge anchors pass through the retainer slots, their forward ends contact the tabs 57 which flexibly yield to let the anchors extend into the body of back panel 12. The slots 60 are of a size such that when the forward face of hinge piece 54 is adjacent the outer edge surface of panel 12, the forward side of slot 12 reaches the forward end of tabs 57 whereupon tabs 57 resiliently snap toward the closed position, with their forward ends retained within and adjacent the forward sides of slots 60. Thus, the hinge piece is retained securely adjacent the side edge of back panel 12.

Figure 6A:
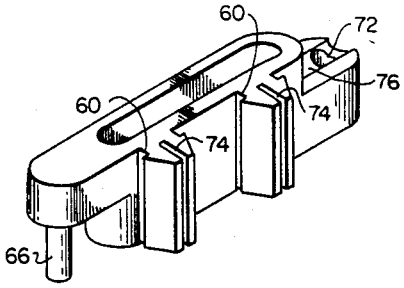
FIG. 6A is a perspective view of another preferred embodiment of one of the hinge members of FIG. 5, illustrating this embodiment of the hinge member as it would appear after being rotated 180° about its longitudinal axis.
Figure 6:
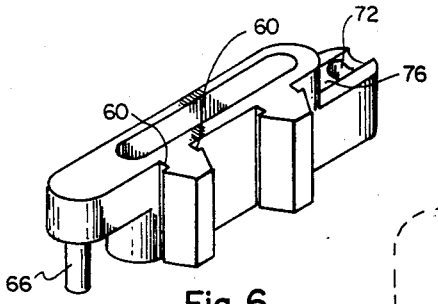
FIG. 6 is a perspective view of one of the hinge members of FIG. 5, illustrating that hinge member as it would appear after being rotated 180° about its longitudinal axis.

FIG. 6 illustrates the hinge piece 54 of FIG. 5 in the inverted position. By referring to FIG. 6, it is also seen that the normally lower surface of the upper support platform 70 defines a longitudinal cavity 76 which is configurated to receive and accommodate longitudinal ridge 64 when hinge pin 66 is extended within pin socket 72 in the manner illustrated in FIG. 5.

An alternative embodiment of the hinge piece 54 is illustrated in FIG. 6A. Referring to FIG. 6A it is seen that in this alternative embodiment material from within the central portion of the hinge anchors 58 has been removed to form compression slots 74. The slots 74 permit sufficient bending or deformation of hinge anchors 58 to allow them to pass through retainer slots 56 of FIG. 5, until the anchors snap back into their normal configuration upon securing the ends of the tabs 57 in indented retaining slots 60. Further, when using hinge anchors of the type illustrated in FIG. 6A, it is possible to use narrower retainer slots 56 without tabs 57 attached thereto. In that configuration the hinge anchors become deformed inwardly as they are inserted through retainer slots 54 until fully inserted, at which time the anchors snap back into normal configuration and secure the side edges of retainer slots 56 within the retaining slots 60.

Figure 7:
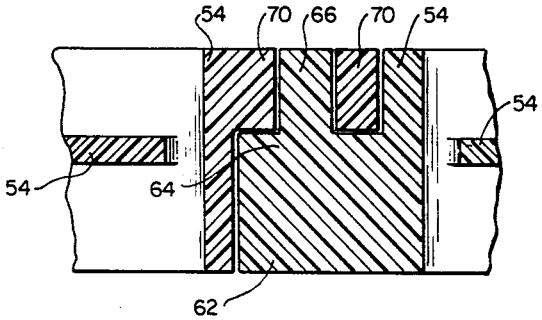
FIG. 7 is a side cross-sectional view of the interconnected hinge members, taken along the lines 7—7 of FIG. 5.

The interconnected relationship of the two adjacent hinge pieces 54 of FIG. 5 can best be described by reference to the cross-sectional view of FIG. 7. Thus, it is seen that pin member 66 is positioned in nesting relationship within the pin socket of upper support platform 70. Support platform 70 is itself supported by the adjacent lower support platform 62.

In operation, the adjacent hinge pieces will tend to align axially with one another as a result of the relationship between the longitudinal ridge 64 and the longitudinal cavity 76 of adjacent, connected hinges. More specifically, as the end panel is moved so as to cause rotation of adjacent hinges pieces 54 about the hinge pin 66, the lower portion of upper support platform 70 is caused to contact and ride upon the upper portion of the adjacent, connected longitudinal ridge 64.

The slope of ridge 64, working in conjunction with gravity on the corresponding slope of the adjacent longitudinal cavity 76, will cause the hinge pieces and the connected back panel to rotate in a direction which will cause the longitudinal cavity 76 to ultimately come to rest in centered and aligned position over the longitudinal ridge 64. This interaction produces the result that the adjacent back panels 12 tend to remain in the closed position unless held or otherwise propped into the open position.

Figure 8:
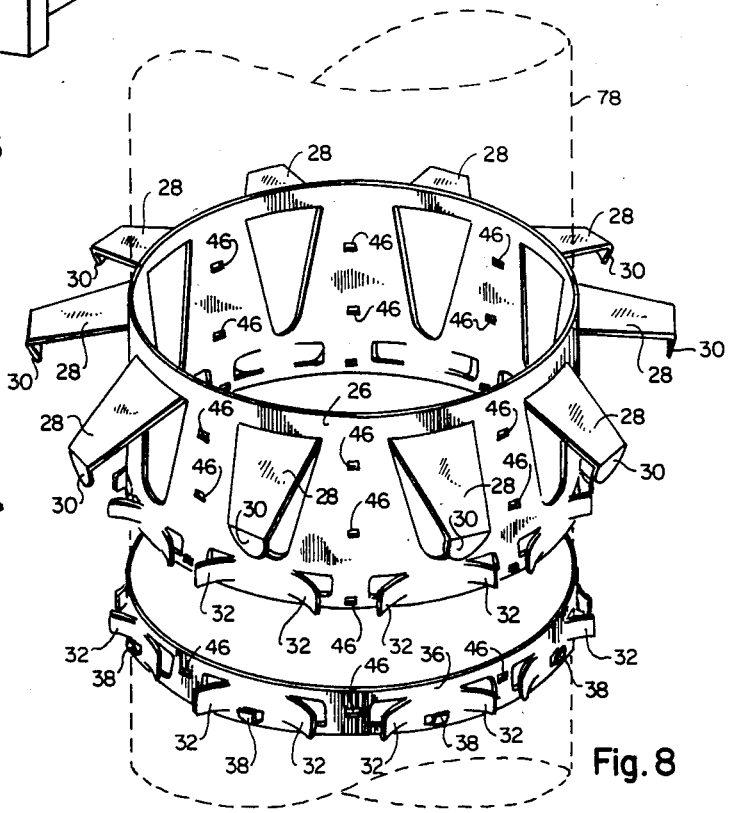
FIG. 8 is a perspective illustration of another presently preferred embodiment of the retaining members of the present invention, as positioned in a carousel configuration.

Another preferred embodiment of the retainer shelves 26 and 36 may be described by reference to FIG. 8. In this embodiment, both retainer shelves 26 and 36 are constructed in an identical fashion to the corresponding shelves 26 and 36 of FIGS. 1–3. However, in the embodiment of FIG. 8, support shelves 26 and 36 are mounted upon a central support shaft 78 (indicated by dashed lines) so as to secure the stored materials around the exterior of shaft 78. This configuration is particularly useful where materials are to be made available to more than one work station, or are otherwise to be stored upon a device such as a rotatable carousel. In this configuration, the user simply rotates the carousel until the desired item becomes accessible. The containers or other items to be stored are secured in the embodiment of FIG. 8 in a manner substantially identical to that of the embodiment of FIGS. 1–3.

Figure 9:
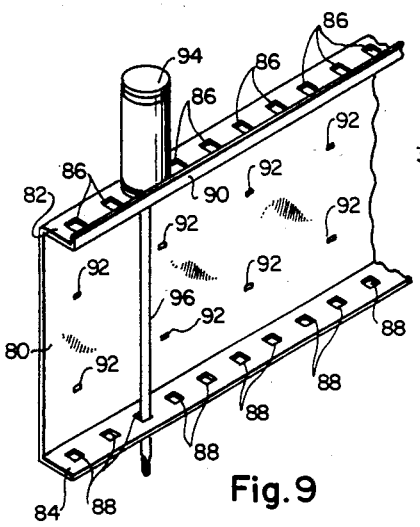
FIG. 9 is a perspective view of another preferred embodiment of a retaining member which is configurated so as to receive and store other types of materials.

Another preferred embodiment for a system for supporting materials to be stored may be described by reference to FIG. 9. In this embodiment, a retainer shelf 80 is shown as it is configurated for supporting screw drivers and similar hand tools. Retainer shelf 80 comprises a unitary structure having an upper support shelf 82 and lower support shelf 84 which both comprise extensions which are bendably formed from the material comprising retainer shelf 80. A plurality of apertures 86 extend in alignment along the length of the upper shelf, so as to receive a portion of the tool to be stored. Positioned in the surface of lower shelf 84 is another plurality of apertures 88 which are positioned in vertical alignment with corresponding apertures 86 of the upper shelf 82.

Extending upwardly from the forward end of the upper shelf 82 is a retaining lip 90 which serves to prevent the forward movement of stored materials. A plurality of assembly apertures 92 are also positioned in the surface of retainer shelf 80, so as to align with and receive the assembly tabs 44 therethrough, when the retainer shelf is secured adjacent the surface of the back panel.

In operation, an item such as a screw driver 94 is secured in the storage system 10 upon the retainer shelf 80 by inserting the lower shaft of the screw driver through one of the upper apertures 86 and then through an aligned, lower aperture 88. The screw driver 94 is supported in position by contact of the forward end of its handle with the upper surface of the shelf 82. When the retainer shelf is in position upon the face of back panel 12, it is preferably positioned so that either the top edge 14 of panel 12, or the lower portion of a another shelf is positioned slightly above the top end of the screw driver. In this manner, longitudinal movement of the screw driver is minimized by its impact with the shelf or panel edge above it. As previously indicated, the forward motion of screw driver 94 is minimized by the lip 90, while motion in other directions is minimized by the amount of space available in aligned apertures 86 and 88 through which shaft 96 extends.

In order to remove the screw driver 94 from the retainer shelf, the screw driver 94 is lifted directly upwardly until its lower portion has sufficient space to pass above the upper end of retaining lip 90. The screw driver is then tilted forwardly and outwardly from the retainer shelf, and is then lifted upwardly so that the shaft 96 is removed from apertures 86 and 88.

Figure 2:
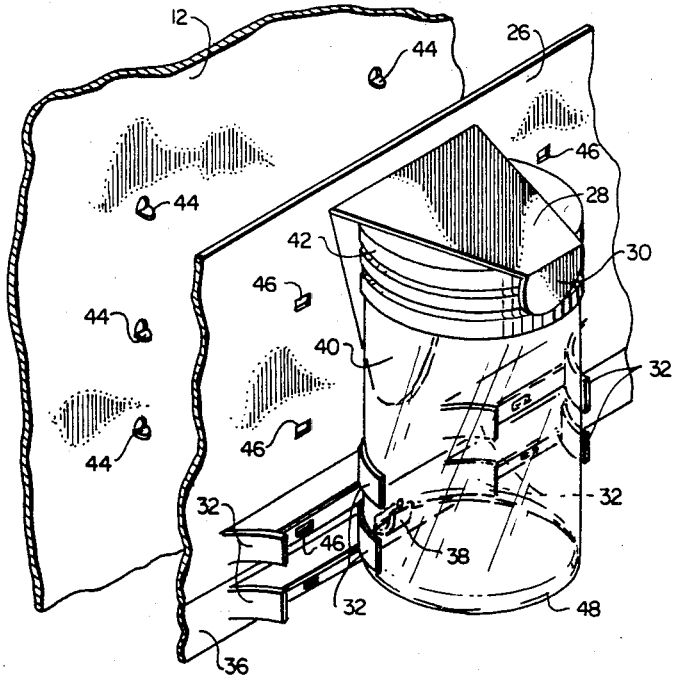
FIG. 2 is an exploded perspective illustration of one presently preferred embodiment of the retaining members of the present invention, illustrating the means by which the retaining members are secured to the wall of the storage panel.

Of course, it will readily be recognized that the retainer shelf 80 could be configurated in two pieces, in a manner similar to the upper and lower retainer shelves 26 and 36 of the embodiment of FIGS. 1–3. Furthermore, it will be appreciated that retaining shelves utilized for mounting things in the present invention could comprise any of numerous configurations depending upon the types of materials to be stored thereon. The shelf system 10 of the present invention is constructed so as to be sufficiently versatile to accept and secure the various types of retaining shelves which may be necessary to store the numerous types of articles and materials which a person may desire to store in such a system.

It will be readily appreciated that the storage system described herein, including the support members, strips, hinges, containers and the other components, may each be constructed of any of numerous types of materials such as metal, wood, plastic and glass, to name a few. The particular material utilized for the various components is largely a matter of choice, and the scope of the invention described herein is not intended to be limited to any one type of material for its construction.

From the foregoing description it will be appreciated that the novel storage system disclosed herein clearly overcomes some of the long standing problems in the art by (1) providing a support system which secures stored materials in a small area and in an organized fashion; (2) providing a choice of locations and schemes for labeling stored materials and identifying their storage location, as well as for providing inventory or other information relating to the stored materials while minimizing the required storage area; (3) providing securing members which securely retain stored materials in order to prevent spillage or other damage during storage and transportation, while also permitting quick and easy access to the secured, stored materials; (4) providing hinge members which permit rapid securing of additional support panels so that the storage capacity may be quickly and easily expanded with a minimum increase in overall storage system size; (5) providing securing devices which permit the storage system to be affixed to a structural surface during use, while being easily transportable by hand; and (6) providing retaining members which are adjustably positioned within the storage system so that any selected portion of the system may be modified to receive and store any of numerous different sizes and configurations of materials.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An expandable storage system for accessibly securing stored articles, comprising:

a plurality of adjacent support panels, each said support panel having at least one edge;

means for securing articles adjacent the support panels;

means for minimizing lateral movement of the articles with respect to the support panels;

means for minimizing longitudinal movement of the articles with respect to the support panels during storage and for permitting sufficient longitudinal displacement of the articles in response to applied pressure such that the articles may be readily removed from the support panels; and hinge means comprising a plurality of hinge members for hingably connecting the adjacent support panels, each of said hinge members being mounted to the edge of a corresponding one of said support panels and each of said hinge members having a peg at one end thereof and a recess formed at the opposite end thereof such that the recess of one hinge member is capable of receiving the peg of an adjacent hinge member.

2. An expandable storage system as defined in claim 1 wherein each of said hinge members has a raised longitudinal edge formed at one end thereof and a corresponding longitudinal cavity formed in the other end thereof.

3. An expandable storage system as defined in claim 1 wherein said hinge means secures the plurality of support panels in proximity to each other such that the support panels may be positioned in parallel and adjacent configuration defining a closed position, and wherein the articles upon any selected support panel may be readily accessed by rotating the panels and hinge means into an open position to expose a selected support panel.

4. An expandable storage system as defined in claim 1 wherein the means for securing articles adjacent the support panels further comprises means for presenting information relating to selected articles in positions adjacent the selected articles.

5. An expandable storage system as defined in claim 1 wherein the means for securing articles adjacent the support panels, the means for minimizing lateral movement and the means for minimizing longitudinal movement are adjustable so as to be usable with different sizes and shapes of articles.

6. An expandable storage system for accessibly securing stored articles, comprising:

a support structure having at least one face;

an upper retainer strip which is detachably secured to the face of the support structure and is selectively positionable thereon, said upper retainer strip securing an upper portion of articles to be stored;

a lower retainer strip which is detachably secured to the face of the support structure and is selectively positionable thereon, said lower retainer strip securing a lower portion of the articles to be stored, said upper retainer strip and said lower retainer strip being capable of relative positioning along said support structure so as to accommodate different sized articles;

means for minimizing lateral movement of the articles with respect to the upper and lower retainer strips; and means for minimizing longitudinal movement of the articles with respect to the upper and lower retainer strips during storage.

7. An expandable storage system as defined in claim 6 wherein the support structure comprises at least one support panel having at least one edge.

8. An expandable storage system as defined in claim 7 further comprising hinge means which are attachable to adjacent edges of the support panels so as to permit multiple panels to be hingedly connected in substantially parallel and close proximity to each other in the closed position, and so that contents of any selected panel may be accessed by rotating the selected panel, on the hinge means, into an open position.

9. An expandable storage system as defined in claim 8 wherein the hinge means comprise means for biasing the panels in the closed position.

10. An expandable storage system as defined in claim 9 wherein the means for biasing the panels is gravity-activated.

11. An expandable storage system as defined in claim 10 wherein said hinge means comprises a plurality of hinge members and wherein said biasing means comprises a raised longitudinal edge formed at one end of each said hinge member and a longitudinal cavity formed in the other end thereof.

12. An expandable storage system as defined in claim 8 wherein the hinge means include anchor members for securing the hinge means to the panels, and wherein the anchor members are extendable through apertures in the panel and are retained within the apertures by resilient retaining members which are affixed to the panels at locations adjacent the apertures.

13. An expandable storage system as defined in claim 8 wherein the hinge means include anchor members for securing the hinge means to the panels, and wherein said anchor members become inwardly deformed when extended through apertures in the panels and wherein, when fully extended through the apertures, the anchor members expand outwardly toward their original configuration, thereby securing the hinge members adjacent the panels.

14. An expandable storage system as defined in claim 6 further comprising means for displaying information relating to selected articles which are secured in the storage system.

15. An expandable storage system as defined in claim 6 wherein the means for minimizing longitudinal movement of the articles comprises a resilient member which contacts the upper portion of an article when the article is secured in stored configuration adjacent the support structure.

16. An expandable storage system as defined in claim 15 wherein the upper portion of the articles to be stored is secured by a retaining member which extends downwardly from the resilient member so as to contact an upper outward portion of the article and prevent outward movement thereof.

17. An expandable storage system as defined in claim 6 wherein the means for minimizing lateral movement of the articles comprises at least two support members which extend generally outwardly from adjacent the support structure so as to support the article when the article is positioned adjacent the support structure, thereby substantially reducing lateral motion of the article.

18. An expandable storage system as defined in claim 17 wherein the article is substantially tubular in configuration and wherein the two support members cooperate to define a cradle configuration which receives and supports the inner tubular-shaped portion of the article.

19. An expandable storage system as defined in claim 6 wherein the means for securing the lower portion of the articles comprises a securing member which extends outwardly and generally upwardly from adjacent the support structure so as to define a retention slot into which a lower edge of the article is extended when the article is positioned adjacent the support structure.

20. An expandable storage system as defined in claim 6 wherein each of the means for securing the upper portion of the articles, the means for securing the lower portion of the articles, the means for minimizing lateral movement of the articles, and the means for minimizing longitudinal movement of the articles are positioned on at least two planar members which are removeably connected to the support structure so that the planar members are adjustable on the support structure.

21. An expandable storage system for accessibly securing stored articles, comprising:

at least one support structure;

means adjustably positioned upon the support structure for securing, adjacent the support structure, an upper portion of articles to be stored;

means adjustably positioned upon the support structure for securing, adjacent the support panel, a lower portion of the articles;

means adjustably positioned upon the support structure for minimizing lateral movement of the articles with respect to the support structure;

means adjustably positioned upon the support structure for minimizing longitudinal movement of the articles with respect to the support structure during storage; and means for permitting ready access to and removal of the articles from adjacent the support structure, each of the means for securing the upper portion of the articles, the means for securing the lower portion of the articles, the means for minimizing lateral movement of the articles, and the means for minimizing longitudinal movement of the articles being positioned on at least one planar member which is removably connected to the support structure so that the planar member is adjustable on the support structure, the planar member comprising a retainer strip which is connectable to the surface of the support structure by means of tabs on the support structure which extend in bendable fashion through corresponding slots in the retainer strip.

22. An expandable storage system for accessibly securing stored articles, comprising:

at least one support panel;

at least one retainer strip which is adjustably secured to a face of the panel;

at least one resilient member extending generally outwardly from the retainer strip such that said resilient member contacts and applies downward pressure to an upper portion of an article when the article is in stored configuration adjacent the support panel, thereby minimizing longitudinal movement of the article;

a retaining lip extending generally downwardly from each resilient member so as to contact an outer, upper portion of the article and prevent outward movement of the article;

at least two support members associated with each resilient member and configured upon a retainer strip so as to extend generally outwardly therefrom in directions such that the outer surfaces of the support members cooperate to receive and support the inward portion of the article when the article is positioned adjacent the support panel, thereby substantially reducing lateral motion of the article; and at least one securing member which extends outwardly and generally upwardly from a retainer strip so as to define a retention slot upon said strip, said retention slot receiving and securing a lower edge of the article when the article is positioned adjacent the support panel.

23. An expandable storage system as defined in claim 22 further comprising hinge means which are attachable to adjacent ends of the panels so as to permit multiple panels to be hingedly connected in substantially parallel and close proximity to each other in the closed position, and so that contents of any selected panel may be accessed by rotating the selected panel, on the hinges, into an open position.

24. An expandable storage system as defined in claim 23 wherein the hinge means are constructed so as to bias the panels in the closed position in response to downward pressure on the panels.

25. An adjustable storage rack for use in a storage system, the storage rack comprising:

at least one unitary, rigid strip;

means located on the rigid strip for securing said rigid strip to a support structure;

a plurality of resilient members integrally connected to the rigid strip and extending generally outwardly therefrom to form an upper retaining member;

a downwardly extending retaining lip connected to the outer end of each resilient member;

at least two support members associated with each resilient member and configurated upon the rigid strip such that their combination is generally aligned with said resilient member, each support member extending from the rigid strip in a direction such that the outer surfaces of the support members cooperate to receive and support an article, thereby minimizing lateral motion of the article; and at least one securing member positioned upon the rigid strip and generally aligned with a resilient member, said securing member extending outwardly and generally upwardly from the rigid strip so as to define a retention slot upon said rigid strip, said retention slot receiving and securing a lower edge of the article when the article is in stored configuration.

26. An adjustable storage rack as defined in claim 25 wherein the means for securing the rigid strip to a support structure comprise slots in the body of the rigid strip, said slots configurated so as to receive bendable tabs extending there through from the support structure, said tabs being bent after extension through the slots, so as to secure the rigid strip upon the surface of the support structure.

27. An adjustable storage rack as defined in claim 25 wherein the resilient members comprise portions of the rigid strip which have been cut and bendably extended outwardly therefrom.

28. An adjustable storage rack as defined in claim 25 wherein the support members comprise portions of the rigid strip which have been cut and bendably extended outwardly therefrom.

29. An adjustable storage rack as defined in claim 25 wherein the securing members comprise portions of the rigid strip which have been cut and bendably extended outwardly therefrom.

* * * * *

UNITED STATES PATENT AND TRADEMARK OFFICE

CERTIFICATE OF CORRECTION

PATENT NO. : 4,569,448

DATED : February 11, 1986

INVENTOR(S) : Charles H. Graham

It is certified that error appears in the above-identified patent and that said Letters Patent is hereby corrected as shown below:

Col. 5, line 49, "retainer" should be --retaining--

Col. 7, line 48, "edges" should be --edge--

Col. 16, line 3, "there through" should be --therethrough--

Signed and Sealed this

*Twentieth* Day of *May 1986*

[SEAL]

*Attest:*

DONALD J. QUIGG

*Attesting Officer*

*Commissioner of Patents and Trademarks*